United States Patent [19]

Heinzl

[11] 4,270,589

[45] Jun. 2, 1981

[54] CONTAINER OF VARIABLE VOLUME

[75] Inventor: Joachim Heinzl, Munich, Fed. Rep. of Germany

[73] Assignee: Siemens Aktiengesellschaft, Berlin & Munich, Fed. Rep. of Germany

[21] Appl. No.: 49,586

[22] Filed: Jun. 18, 1979

[30] Foreign Application Priority Data

Jul. 20, 1978 [DE] Fed. Rep. of Germany ..... 2831999

[51] Int. Cl.[3] ..... B65D 1/40; B65D 7/42; B65D 83/00

[52] U.S. Cl. ..... 150/0.5; 215/16; 229/8

[58] Field of Search ..... 229/8, DIG. 3; 215/1 C; 150/0.5

[56] References Cited

U.S. PATENT DOCUMENTS

| | | | |
|---|---|---|---|
| 2,685,316 | 8/1954 | Krasno | 229/DIG. 3 UX |
| 2,936,939 | 5/1960 | Lundquist | 229/8 |
| 2,992,829 | 7/1961 | Hopkins | 229/8 UX |
| 3,004,696 | 10/1961 | McCormick | 229/8 UX |
| 3,083,877 | 4/1963 | Gash | 215/1 C |
| 3,668,796 | 6/1972 | Patterson | 229/8 UX |
| 3,872,994 | 3/1975 | Hyde | 215/1 C X |
| 3,918,603 | 11/1975 | Hatada | 215/1 C X |
| 4,147,279 | 4/1979 | Matsui | 150/0.5 |

*Primary Examiner*—Davis T. Moorhead

*Attorney, Agent, or Firm*—Hill, Van Santen, Steadman, Chiara & Simpson

[57] ABSTRACT

A container of variable volume is disclosed consisting of parallel spaced polygon surfaces peripherally interconnected via triangular surfaces which join one another. The triangular surfaces are shaped and interconnected such that when the two polygons move relative to one another they undergo a rotational movement relative to one another. The triangular surfaces may, in place of having their ends attached to the polygons, be attached to a further set of triangular surfaces whereby the stack height of the container may be incrementally increased. Fold-up containers as herein disclosed may be used as ink supply containers for ink recording devices.

5 Claims, 3 Drawing Figures

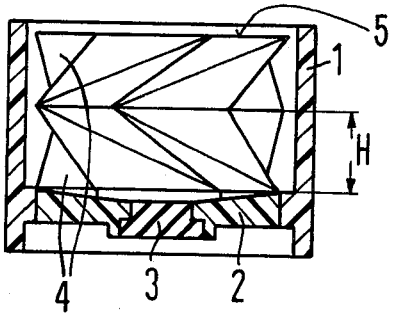
FIG 1
FIG 2
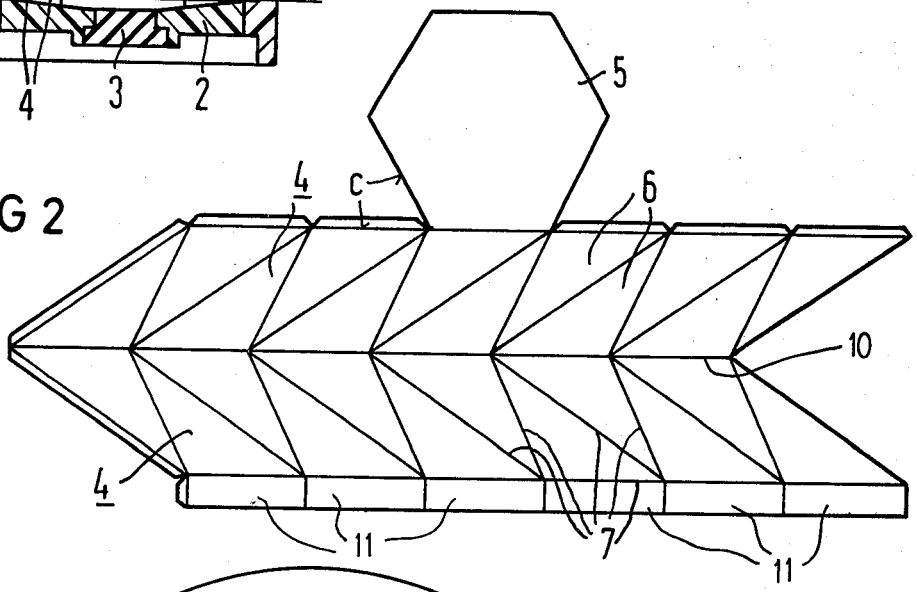
FIG 3
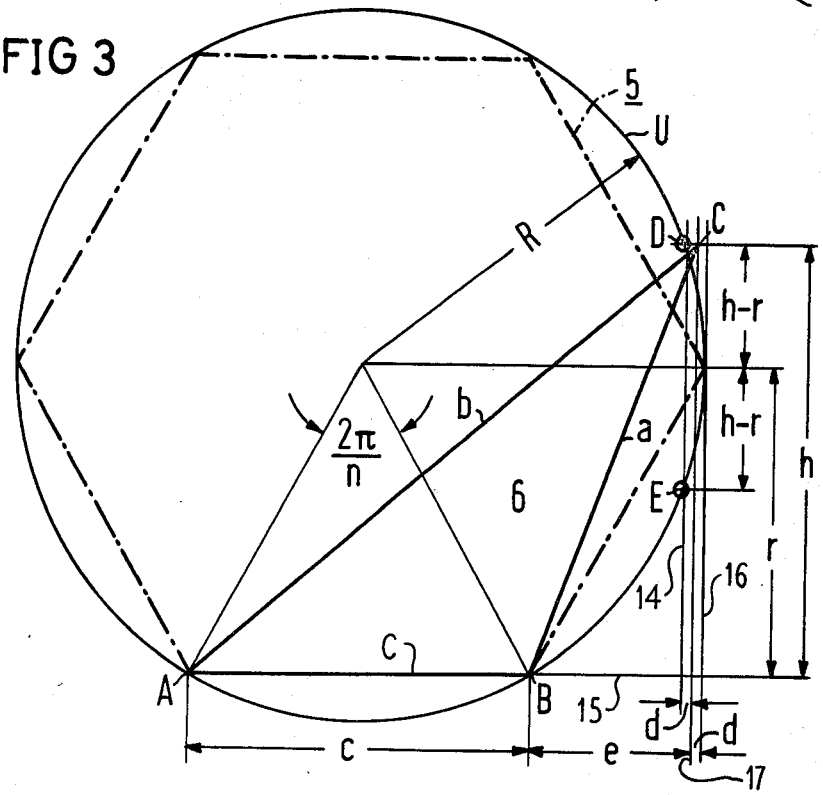

CONTAINER OF VARIABLE VOLUME

BACKGROUND OF THE INVENTION

1. Field of the Invention

This invention relates to hollow containers and more particularly to containers of variable volume having at least one substantially rigid boundary surface. In particular, this invention is directed to variable volume containers utilizable for storing fluid ink or supplying ink to ink recording devices such as ink mosaic recorders for office machines, data printers or teleprinters.

2. Prior Art

Ink recording devices such as, for example, office machines utilizing ink mosaic recorders, jet ink printers, data printers, etc. are frequently provided with replacable and/or disposable ink storage containers. Such containers include both open and closed ink supply containers. Generally, ink supply containers of the open type utilize basically rigid walls. In such cases the volume of consumed ink is replaced in the container by in-flowing air.

Alternatively, it has been known to use basically closed ink supplied containers. Such closed supply containers have numerous advantages such as avoidance of pollution of the ink by being mixed with solid, liquid or gaseous substances. Additionally, closed containers effectively reduce or limit ink evaporation. In order to compensate for volume loss of consumed ink in such closed containers, it is necessary to design at least a part of the container wall to be movable. In practice this is meant that flexible foils which follow the escaping ink liquid are used as mobile wall components.

For example, it is known (German Offenlegungsschrift No. 2,323,762) to provide an ink supply in an ink bag constructed of flexible foil which is received between two plates of suitable shape. On the other hand, it has also been known (see for example German Offenlegungsschrift No. 2,610,518) to construct the ink supply container from two cooperating components. For example, one component could be a half-shell of substantially rigid shape and the other component a joining wall composed of a flexible foil which may be a mirror image to the rigid shell.

In such embodiments, the flexible foils must be sufficiently thin to exhibit the desired flexibility and are therefore correspondingly liable to damage thus requiring protective measures. If the flexible foils are elastically deformable they exert an elastic force upon the enclosed ink liquid which changes in dependence to the degree of expansion of the foil. Such changing pressure is undesirable for a clean printing operation. Flexible foil material which, on the other hand, is not or is only slightly elastically deformable, will fold upon itself forming folds which differ in degree of definition and in number during positional changes of the foil. During formation and release of the folds, the enclosed ink liquid may again be subject to differing forces which unfavorably influence the printing system.

It would therefore be an advance in the art to provide a flexible, collapsable ink supply container having basically stable shaped wall components and wherein the volume change occurs along predetermined fold lines substantially under conditions which are identical over the entire volume change zone.

SUMMARY OF THE INVENTION

Therefore the general object of this invention is to provide an improved variable volume ink supply container having wall components which are fundamentally stable in shape and in which the change in the volume occurs by reason of a folding of the wall components relative to one another under conditions which are substantially identical over the entire change zone.

A container of variable volume complying with the above general object is constructed, according to this invention, by forming the container of two identical regular polygons of substantially stable or rigid shape, positioned in parallel planes, the container having a number of congruent triangular surfaces corresponding to the number of sides of the two polygons forming peripheral walls of the container. Each triangular surface on one side of the polygons is articulated by an equal length base side to the polygon. The other two sides of the triangular surfaces are articulated to sides or triangular surfaces which in turn are articulated to the opposite polygon. Each triangular surface can then be described as having a base side articulatably connected to one straight side of the regular polygon, the triangular surface or member having two sides projecting from the straight side of the polygon, each of those sides being articulatably connected to respective sides of another triangular member or surface having its third side articulatably connected to a straight side of the second regular polygon.

Each of the triangular members or surfaces is dimensioned in such a manner that the apex point (the point of intersection of the two sides not articulatably connected to the polygon straight side) is positioned above the base side of the triangle and is laterally disposed relative thereto on a straight line which is perpendicular to the base side and is moreover displaced parallel to the tangent of the polygon periphery by an amount permitted by the deformability of the material and the articulated connection. Further, the apex point is located above the base side at a height whose projection length to the polygon plane at the maximum corresponds to the distance of the base side from the remote intersection of the polygon perimeter with a straight line displaced in parallel relative to the circle tangent to the polygon circle by a double amount permitted by the deformability of the material in the articulated connections as will be more fully explained hereinafter.

A variable volume container corresponding to this invention is on the one hand characterized by a relatively high degree of stability and on the other hand, in particular, by a uniform behavior in relation to the enclosed ink liquid in the event of changes in volume, substantially throughout the entire permissable range of volume change.

The above discussed properties are achieved by taking into account geometric relationships for the design of the individual surfaces and a given deformability of the material and/or the articulated connections. Since, during the folding process, the corner points of each the triangular surfaces which lie opposite the base side of the triangular surfaces and which abut against the corners of the opposite polygon move on an adjacent tangential plane of the polygon periphery, the two polygon surfaces will be rotated relative to one another. The particular angle of rotation can be exploited to indicate the volume contents of the container.

In accordance with the preferred embodiment of the invention, the container is characterized in that the height of the triangular surfaces or members above their base sides corresponds to the length of a straight line governed by the base side from the remote intersection point of the polygon periphery with a straight line which is displaced in parallel relative to the previously mentioned tangent to the polygon circle by an amount which is twice that permitted by the deformability of the material and/or the articulated connection. In a container designed in this way the two polygons can virtually be brought close enough to touch one another except for the thickness of the folded triangular surfaces. In this manner scarcely any enclosed volume will remain in the fully folded or collapsed container.

In accordance with a further development of the invention, the variable volume container is additionally characterized in that at least one polygon periphery defined by the triangular base surfaces is not connected to a polygon but is rather connected to a polygon periphery of another set of triangular wall surfaces. By this, it is meant that the basic container consists of two parallel polygons interconnected by a peripheral wall of opposed triangles with the triangles alternatingly having base lines connected to one or the other of the polygons. However, one polygon can be eliminated and a second, identical container, having one polygon eliminated can be coupled to the first container along the base lines of the triangles associated with the eliminated polygons. In this manner the height of a variable volume container according to this invention can thus be effectively doubled. Indeed, the stack height of a container according to this invention can be successively added to by adding additional intermediate container peripheral wall sections of articulated triangles.

In an embodiment utilizing two stack open ended containers, the lateral shift of the corners of the triangular members remote from the base sides in the stacked adjacent containers will take place in opposite directions. In this construction the rotation of the polygons relative to one another which occurs in the case of a volume change is compensated within the container components themselves.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a side view partially in section of an ink supply container according to this invention.

FIG. 2 is a diagrammatic developmental view of the container of FIG. 1.

FIG. 3 is a diagrammatic view illustrating the geometric relationships of the dimensionings of the elements of the container of FIG. 1.

DESCRIPTION OF THE PREFERRED EMBODIMENTS

The embodiment of the invention shown in the drawings and hereinafter further explained is based upon a container base surface having the shape of a regular hexagon. Similar shapes in consideration apply to containers having base surfaces in the form of regular polygons having a different, arbitrary number of corners.

An increasing number of corners or sides relative to the extent of the base surface can result in a greater height being obtained with an equal base surface but also increases the number of articulated connections between the individual surface elements and thus, for example, the expense of production.

As generally shown in FIG. 1, a housing 1 has a container system incorporated therein for receipt of an ink liquid. The base surface 2 of the container includes an inserted housing component centrally thereof which may be provided with a rubber plug which can be penetrated by a hollow needle to allow withdrawal of the ink liquid. The base surface 2, in this embodiment, forms one of the parallel polygons defining the end walls of the container. The container system disclosed is constructed from a double stack of peripheral triangular wall elements. Thus, the illustrated enclosure is a double height which may be considered as being composed of two opposed open ended containers joined along their peripheral walls wherein the walls of each open ended container are formed of the triangles necessary for the construction of a single system. Thus, the peripheral walls of each row is numbered 4, it being understood that there are two rows connected together at their common ends 10 which, in a single stack height, would instead be connected to the parallel polygon. Moreover, in the illustration shown in FIG. 2, only one polygon 5 is shown, the other polygon being understood to be the base 2 of the housing 1 which would be attached to the triangle base flaps 11.

The laid out drawing or developmental drawing of FIG. 2 shows that the top surface 5 of the upper container component is constructed as a regular hexagon. There is no boundary between the two components 4, but the boundary edges 10 form a regular hexagon which coincides with the top surface 5. As has already been mentioned with reference to FIG. 1, the base surface of the lower container component 4 is formed by a wall component 2 of the housing 1 and in fact is likewise formed as a regular hexagon. The side elements or peripheral walls of the individual container components 4 are formed from triangular members or surfaces 6 which are connected to one another and to the top 5 and base 2 hexagons. The triangular surfaces of the opposed container components are similar but homologous. The individual wall components of the container components 4 (which are connected to one another) consist, preferably, of a foil like material and are provided with fold lines 7 at the illustrated positions. The fold lines 7 form articulations between the triangular surfaces or members 6 and with the base surface 2 and top surface 5. Thus, although it is possible to visualize each of the triangular surfaces 6 as an independent member articulated along its edges to another independent member, in practice, the device is constructed of foil or other sheet material (plastics, papers, metal foil, etc.) having fold lines defining triangular surface portions.

The principles on which the design of the wall components of the containers are based will be explained in reference to FIG. 3. A base surface of the container, e.g. the top surface 5, has been shown in dash-dotted lines as a regular hexagon. This hexagon is surrounded by a circle U having a radius R generated on the points of the hexagon. The design of a triangular surface 6 is based on the consideration that the triangular surface 6, having the corner points A, B, C, can only be turned about the folding edge c when the corner point C of the triangle 6 can describe its path of movement on the one hand in a plane at right angles to the straight line (edge) c and simultaneously in a tangential plane of the circle U. Expressed purely geometrically, this condition is fulfilled only in one single position of a correspondingly designed triangle so that a solution does not appear possible along these lines.

However, if one additionally considers a given fact, theory can also confirm the practical result that, with similar original geometric conditions, it is possible to fold a correspondingly designed container in accordance with fixed rules. The practical fact which is to be additionally considered consists in the low degree of deformability of the material, and also, in particular, the deformability within the articulated connections. On the basis of recognition of this the considerations illustrated in FIG. 3 lead to a practicable result.

If the desired turning plane for the corner point C of the triangular surface 6 is displaced into the circle U by the amount d of the deformability of the tangential plane of the circle, again exploiting the deformability, the corner point C of the triangular surface 6 acquires a turning path which results from the intersection points D and E of the circle U with a plane displaced in parallel to the tangential plane of the circle U by double the deformability amount d into the circle U. A triangular surface 6 having the corner points A, B and C and sides a, b, c complies with this condition. The following geometric laws apply:

(1) the side c of the triangular surface 6 corresponds to the length of one side of the polygon, (2) the length of the side b results from $$b = \sqrt{(R - d - \frac{c}{2})^2 + h^2},$$

(3) the length of the side a results from $$a = \sqrt{(R - d - \frac{c}{2})^2 + h^2},$$

(4) the lateral displacement e of the corner point C from the side c results from $c = R - d - c/2$.

The center point of the circle lies above the straight line defined by the side c by the amount r and the corner point C lies above this straight line by the amount h. Thus, $a = 2R \sin \pi/n = 2r \tan \pi/n$, $h = r + 2\,d\,(R - d)$. The attainable height H (FIG. 1) of a simple container results from $H - 2\,r\,(h - r)$; in the exemplary embodiment this amount is doubled.

The value h corresponds directly to the height of the triangular surface above the side c under the condition which has been imposed here that the two polygon sides are to be able to virtually meet one another. If a residual clearance, i.e. a residual volume is to remain, the height of the triangular surface 6 above its side c is derived from the root of the sum of $h^2$ and the squared amount of the residual height. Then the value h merely represents the projection of the actual height of the triangular surface 6 to the polygon plane.

Assuming a regular hexagonal base surface with a deformability d of material and in particular in the articulated connections, and a standard side length of $c = 1$, the following tables of values can be drawn up:

| d | e | h | H |
|---|---|---|---|
| 0.01 | 0.490 | 1.065 | 0.83 |

-continued

| d | e | h | H |
|---|---|---|---|
| 0.001 | 0.499 | 9.929 | 9.47 |

The exemplary embodiment illustrated in FIGS. 1 and 2 comprises two individual containers assembled to form a container system, in which the common polygon base surface is open. By additionally adding individual containers of identical form without wall components to the common polygon base surfaces it is possible to produce a tubular structure of variable length.

From the above it can be seen that the height or maximum distance of the apex (C) of the triangular surfaces 6 from their base (c) is equal to the maximum height or length of a straight line (14) which is perpendicular to an extension (15) of the base measured from the base extension (15) to a remote intersection point (D) on the generated circle (U) of the polygon (5) periphery. The point (D) is spaced inwardly from a line (16) tangent to the generated circle (U) by a distance which is twice the distance factor (d) determined by the deformability of the material and/or articulated connection (7). The apex (C) is further offset from the base (c) by a distance (e) which is equal to the distance from the near end (B) of the base (c) to a line (17) parallel to the tangent line (16) but spaced inwardly therefrom by the distance factor (d).

Although the teachings of my invention have herein been discussed with reference to specific theories and embodiments, it is to be understood that these are by way of illustration only and that others may wish to utilize my invention in different designs or applications.

I claim as my invention:

1. A closed variable volume container with stable wall components connected by fold lines accomodating uniform folding of the wall components to collapse the container to a substantially no volume enclosure which comprises a pair of opposed end walls of equilateral polygonal shape positioned in parallel planes, one of said end walls being rigid and having a dispensing outlet, an intermediate peripheral wall connecting said end walls adapted to fold to bring the pair of end walls together, said peripheral wall having a plurality of axially stacked rows each formed from a plurality of congruent triangular walls equal to twice the number of sides of the polygonal end walls, each row having opposite ends formed by base lines of half of the triangular walls, fold lines connecting the two sides of each triangular wall to the sides of two adjacent triangular walls with the base lines defining spaced parallel polygonal area and each triangular wall having a corner point opposite its base line offset laterally from the base line to turn as the container is collapsed and effect folding of the triangular walls on their fold lines.

2. The container of claim 1 wherein the lateral offsets of the corner points are on a straight line perpendicular to the base and displaced parallel to the tangent of a polygonal circle encompassing the end walls by an amount allowed by deformability of the material forming the triangular walls and the fold lines.

3. The container of claim 2 wherein each corner point is spaced from the base of the triangular wall by a distance having a maximum projection length which is twice the distance of the spacing between said straight line and the tangent of said circle.

4. The container of claim 1 wherein both end walls are rigid.

5. The container of claim 1 wherein the lateral offset of the corner points in adjacent rows is in opposite directions.

* * * * *